US007798827B1

(12) United States Patent
Lee

(10) Patent No.: US 7,798,827 B1
(45) Date of Patent: Sep. 21, 2010

(54) INTRINSICALLY SAFE ELECTRICAL OUTLET

(76) Inventor: Shu-Hang Lee, A1716, Huakai Square, Yuanmei Road, Nancheng District, Guangdong (CN)

( * ) Notice: Subject to any disclaimer, the term of this patent is extended or adjusted under 35 U.S.C. 154(b) by 0 days.

(21) Appl. No.: 12/464,828

(22) Filed: May 12, 2009

(51) Int. Cl.
*H01R 13/44* (2006.01)

(52) U.S. Cl. ..... 439/137; 439/145; 439/188

(58) Field of Classification Search ..... 439/137, 439/145, 188
See application file for complete search history.

(56) References Cited

U.S. PATENT DOCUMENTS 4,230,386 A * 10/1980 Farnworth et al. ..... 439/188
4,722,693 A * 2/1988 Rose ..... 439/137
6,537,088 B2 * 3/2003 Huang ..... 439/137
6,814,594 B1 * 11/2004 Huang ..... 439/137
7,641,489 B1 * 1/2010 Hsu et al. ..... 439/188

* cited by examiner

*Primary Examiner*—Truc T Nguyen
(74) *Attorney, Agent, or Firm*—Global IP Services; Tianhua Gu

(57) ABSTRACT

The present invention provides an intrinsically safe electrical outlet, which is fitted with a shell accommodating a live wire stub and a live wire conductive clip; a protective device is disposed on the live wire stub' the protective device has a shell, wherein there are a moveable connecting block and a return spring; when the pin of the plug is inserted into the electrical outlet, the connecting block is activated so that the live wire conductive clip is electrically connected with the live wire pin of the plug. As the live wire stub in the shell is enclosed in a protective device, the metal objects or other conductive bodies may not get contact with the live wire conductive clip and cause electric shock or leakage even if they are extended accidentally into the jack; satisfactory safety could be realized since the live wire conductive clip is electrically connected with the plug's live wire pin only when certain forced is applied to the plug pin and insert it into the jack.

6 Claims, 5 Drawing Sheets

INTRINSICALLY SAFE ELECTRICAL OUTLET

FIELD OF THE INVENTION

The present invention relates generally to an electrical outlet, and more particularly to an intrinsically safe electrical outlet which can prevent electric shock and leakage.

BACKGROUND OF THE INVENTION

As for existing electrical outlets, the jacks are generally exposed. If metal objects or other conductive bodies are brought accidentally into contact the metal sheet in the jack, serious safety hazards exist due to possible electric shock and leakage.

To resolve this problem, the electrical outlets have been modified in the design work, such as a flapper is arranged in front of the jack; when connected with the plug, the pin of the plug can be inserted into the jack by pushing off the flapper; when the pin is removed, the flapper can be reset automatically to seal the jack. Such design could improve the safety of electrical outlet to some extent. However, in case where the flapper isn't fully reset during frequent operation, some metal objects are possibly inserted into the jack, leading to safety hazards arising from electric shock and leakage.

SUMMARY OF THE INVENTION

The main objective of the invention is to provide a new intrinsically safe electrical outlet that can prevent electric shock and leakage for higher safety.

The intrinsically safe electrical outlet of this invention comprises an electrical outlet housing enclosed with a live wire stub and a live wire conductive clip, a protective device is disposed on the live wire stub; the protective device is provided with an shell, wherein there are a moveable connecting block and a corresponding return spring; when the pin of the plug is inserted into the electrical outlet, the connecting block is activated so that the live wire conductive clip is electrically connected with the live wire pin of the plug.

A chamber is opened in front of the shell of the protective device, and the connecting block made of conductive material is located within the chamber; the rear end is close to the live wire conductive clip, the front end protruded closely to the jack on the electrical outlet housing, the lower end mated with the chute on the side wall of shell via a pivot, and the upper end mated with the return spring at rear end of the chamber; when the plug's live wire pin is inserted into the electrical outlet, the connecting block is driven to contact the live wire conductive clip, so that the live wire conductive clip is electrically connected with the plug's live wire pin.

A limitation bar for limiting the rotation angle of connecting block is arranged at front top of the chamber.

In the front of the shell of protective device, there is a chamber, wherein the connecting block is located; a conductive foundation is placed at the bottom of the chamber, and connected with the jack clip of live wire correspondingly to the live wire jack; the connecting block is made of insulative portion and conductive portion, of which the insulative portion is close to the jack of ground/zero wire of the electrical outlet housing, with its upper end mated with the return spring at rear end of the chamber; the conductive portion is close to the live wire conductive clip, with its lower end mated rotarily with the conductive foundation; when the ground/zero wire pin of the plug is inserted into the electrical outlet, the conductive portion of the connecting block is pushed to contact the live wire conductive clip, so that the live wire conductive clip is electrically connected with the plug's live wire pin.

The connecting block's insulative portion is made of plastic, and conductive portion made of copper block.

The connecting block's insulative portion and conductive portion are adhered together, or adhered onto a wedged surface.

The advantages of this utility model include: as the live wire stub in the electrical outlet housing is sleeved with a protective device, the metal objects or other conductive bodies may not get contact with the live wire conductive clip and cause electric shock or leakage even if they are extended accidentally into the jack; electric conduction between the live wire conductive clip and the plug's live wire pin occurs only when a certain force is applied to the plug pin and insert it into the jack.

DETAILED DESCRIPTION OF THE INVENTION

The following paragraphs present the preferred embodiments of the utility model, without limitation of the scope of the Claims.

Embodiment 1

Figure 1:
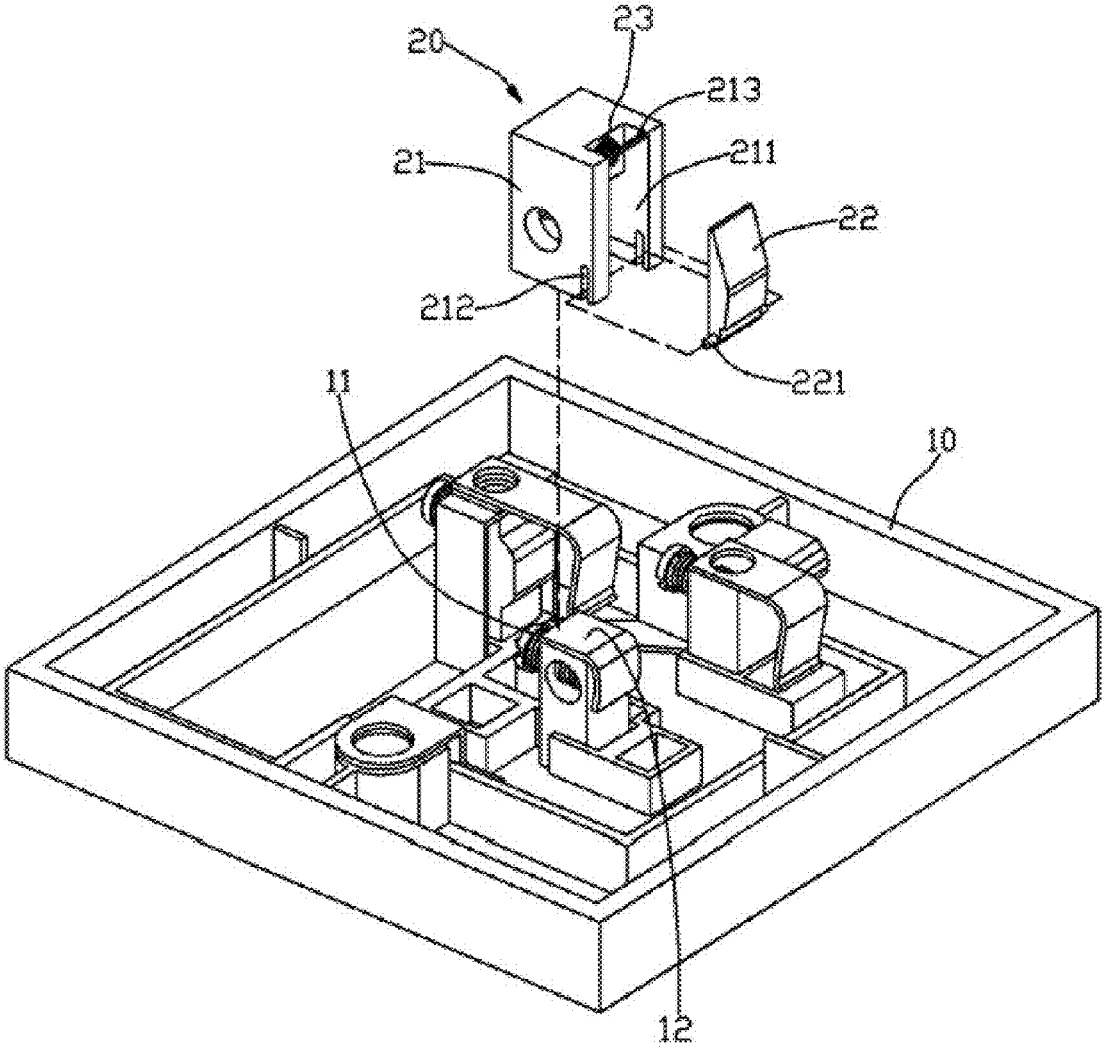
FIG. 1 shows an exploded view of the preferred embodiment of the invention.
Figure 2:
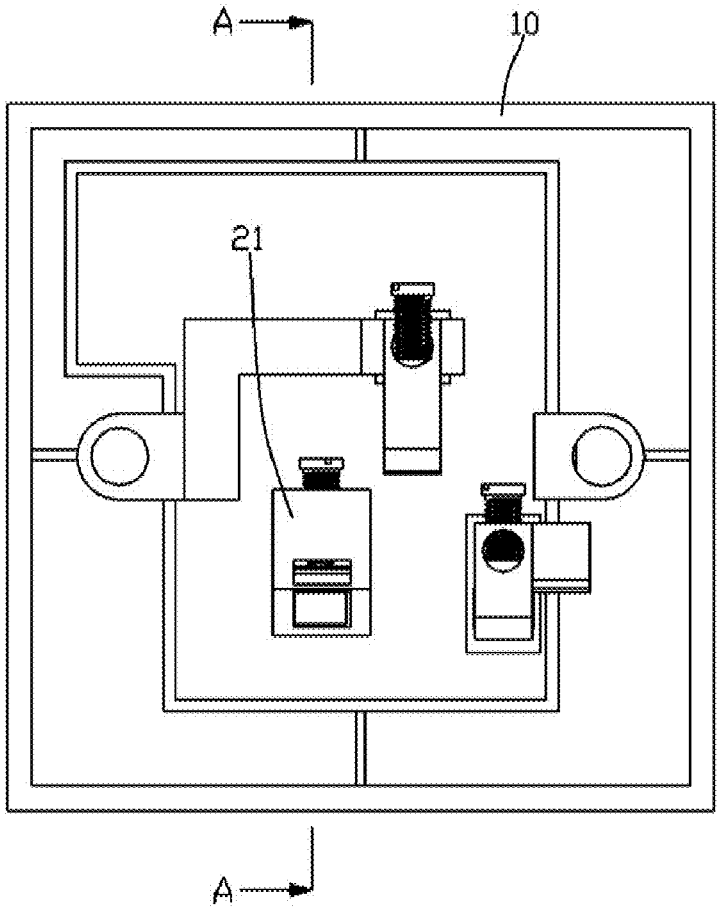
FIG. 2 shows a front view of the preferred embodiment of the invention that the electrical outlet is mated with the plug.
Figure 3:
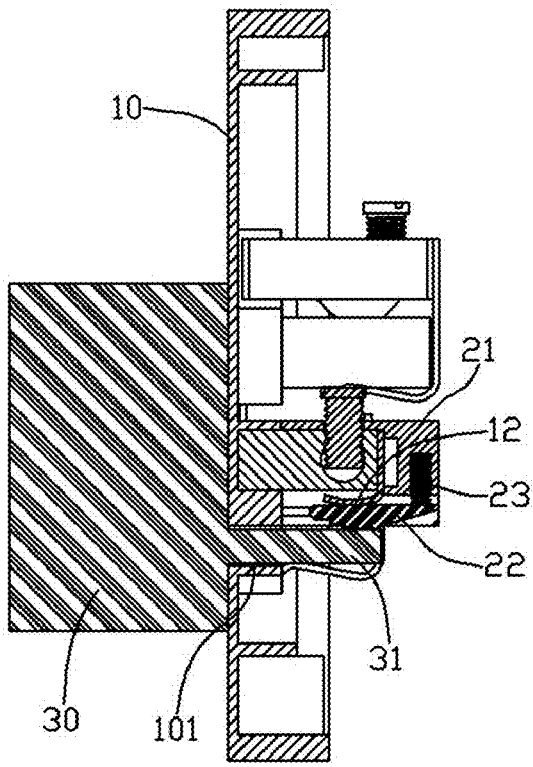
FIG. 3 shows an A-A sectional view of FIG. 2.
Figure 4:
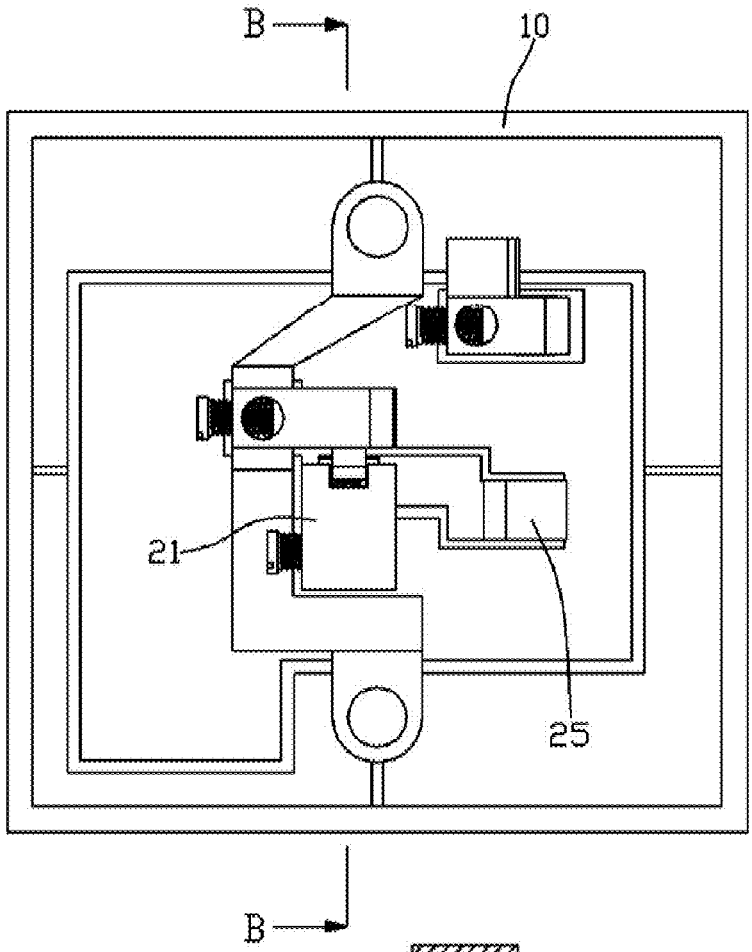
FIG. 4 shows a front view of the second preferred embodiment of the invention.
Figure 5:
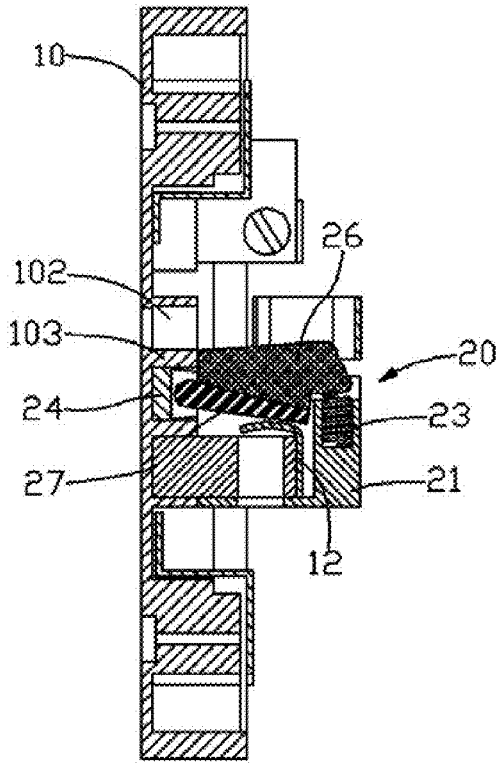
FIG. 5 shows a B-B sectional view of FIG. 4.
Figure 6:
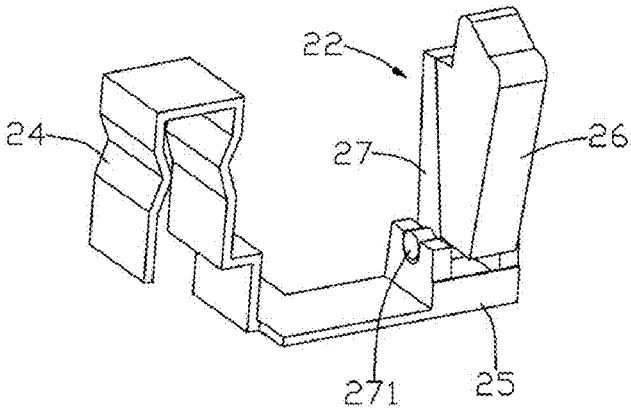
FIG. 6 shows another preferred embodiment of the invention
Figure 7:
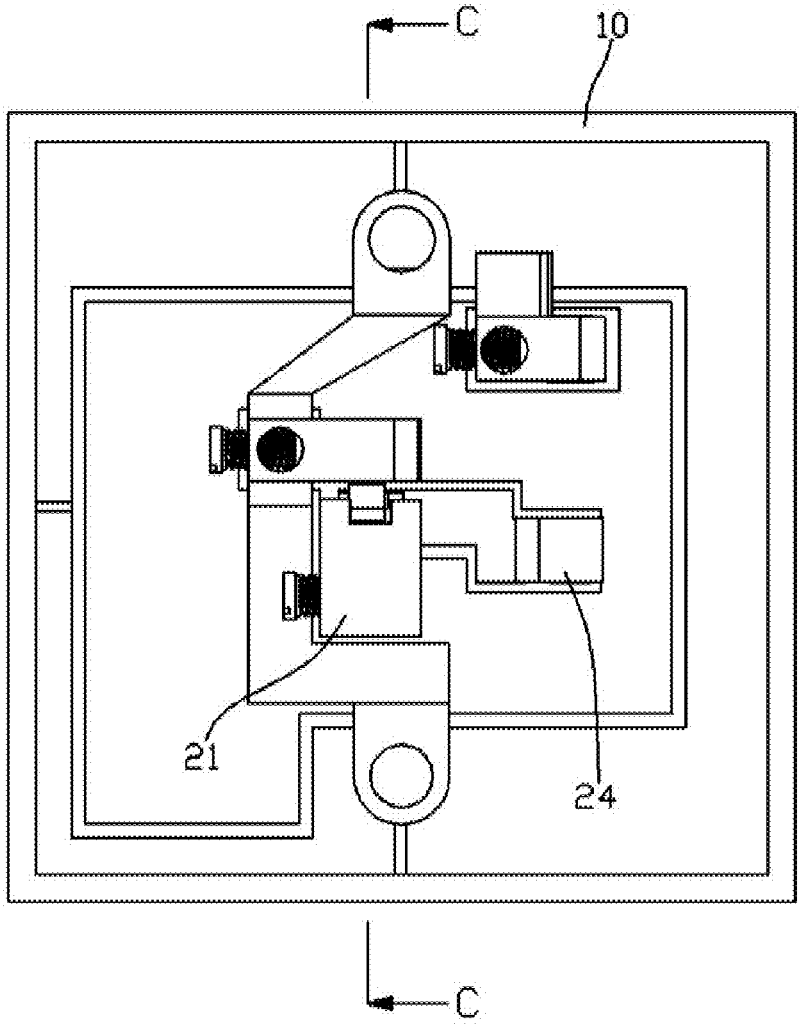
FIG. 7 shows another front view of the preferred embodiment of invention that the electrical outlet is mated with the plug.
Figure 8:
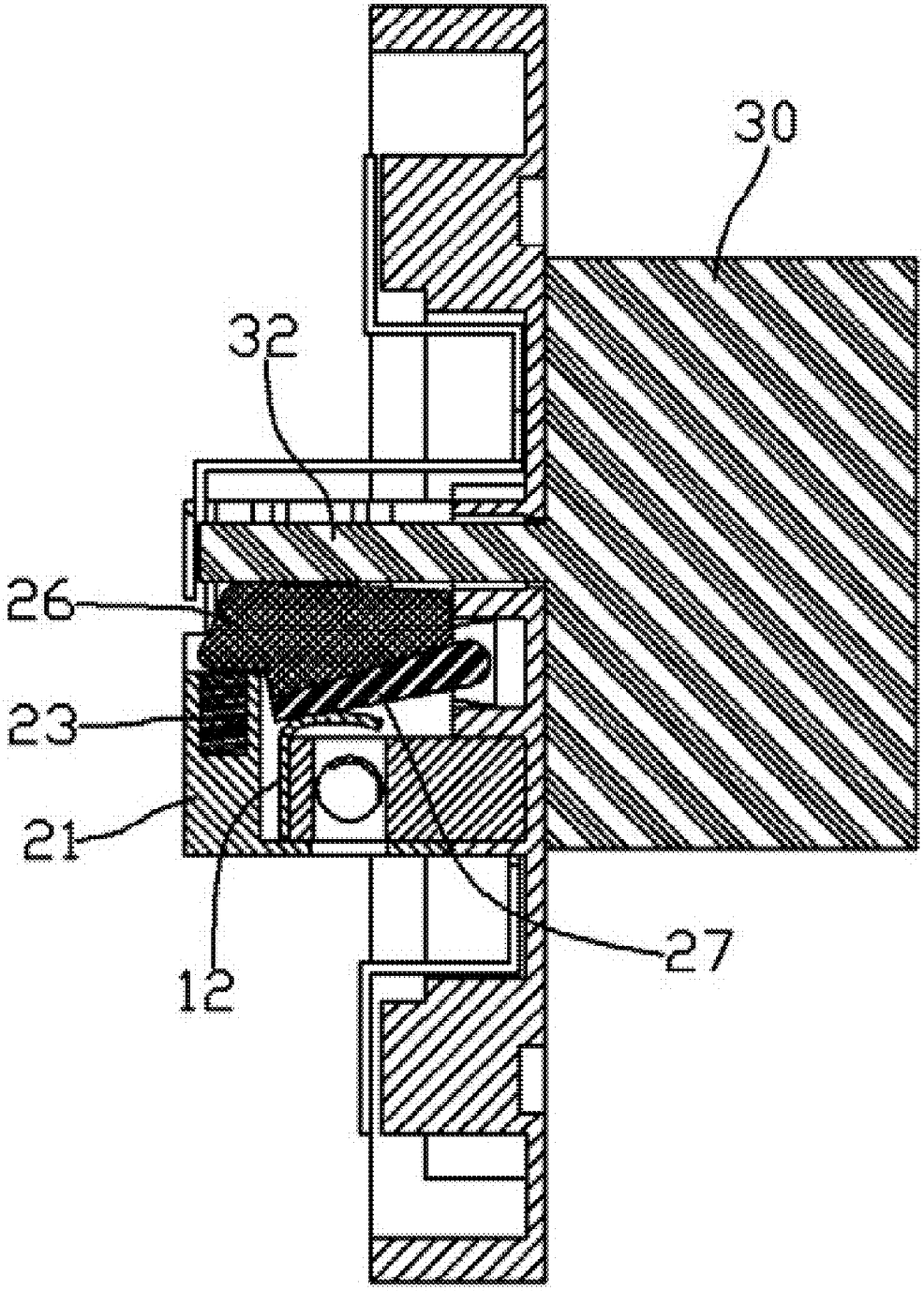
FIG. 8 shows a C-C sectional view of FIG. 7.

Referring to FIGS. 1~3: the intrinsically safe electrical outlet of the utility model is provided with a rectangular electrical outlet housing 10, wherein there are alive wire stub 11 and a live wire conductive clip 12; a protective device 20 is disposed on the live wire stub, the protective device 20 is provided with a shell 21, at front of which a chamber 211 is placed; the connecting block 22 made of copper is located within the chamber 211, of which the rear end is close to the live wire conductive clip 12, the front end protruded closely to the jack 101 on the electrical outlet housing 10, the lower end mated with the chute 212 on the side wall of shell 21 via a pivot 221, and the upper end mated with the return spring 23 at rear end of the chamber 211; besides, a limitation bar 213 for limiting the rotation angle of connecting block 22 is arranged at front top of the chamber 211.

When the live wire pin 31 of the plug 30 is inserted into the electrical outlet housing 10 from the live wire jack 101, the live wire pin 31 contacts the bulge at front middle portion of the connecting block 22, and pushes the connecting block 22 to rotate and contact the live wire conductive clip 12, so that the live wire conductive clip 12 is electrically connected with the live wire pin 31 of the plug 30. When the plug 30 is removed from the electrical outlet, the connecting block 22 is rotated counterclockwise under the action of the return spring 23, such that the connecting block 22 is disengaged from the live wire conductive clip 12. With such design, the safety of electrical outlet could be improved greatly even if the metal objects or other conductive bodies are extended accidentally into the live wire jack 101.

Embodiment 2

Referring to FIGS. 4~7: a conductive foundation 24 is arranged at the bottom of the chamber 211 of the shell 21 of the protective device 20, and connected with the jack clip of live wire 25 correspondingly to the live wire jack; the connecting block 22 is composed by a plastic insulative portion 26 and a copper conductive portion 27, the two portions can be joined by glue, the joint face is a wedged surface ; the insulative portion 26 is close to the ground wire jack 102 (or zero line jack) of the electrical outlet housing 10, of which its upper end is mated with the return spring 23 at rear end of the chamber 211, and supported by the return spring 23 onto the flange 103 of ground wire jack 102; the conductive portion 27 is close to the live wire conductive clip 12, with its lower end mated rotarily with the conductive foundation 24 via axle 271.

When the ground wire pin 32 of the plug 30 is inserted into the electrical outlet housing 10 from the ground wire jack 102, the ground wire pin 32 pushes the connecting block 22, and makes conductive portion 27 get in touch with the live wire conductive clip 12, so that the live wire conductive clip 12 is electrically connected with the live wire pin 31 of the plug 30. When the plug 30 is removed from the electrical outlet, the connecting block 22 is rotated counterclockwise under the action of the return spring 23, such that the connecting block 22 is disengaged from the live wire conductive clip 12.

What is claimed is:

1. An intrinsically safe electrical outlet comprising:

a live wire stub and a live wire conductive clip;

wherein a protective device is disposed on the live wire stub, the protective device has a shell, in which a movable connecting block and a return spring are accommodated;

when a plug's live wire pin is inserted into a live wire jack of the safe electrical outlet, the connecting block is driven to contact the live wire conductive clip, thereby the connecting block and plug's live wire pin are powered, when the plug's live wire pin is pulled out, the connecting block is pushed back to disconnect with live wire conductive clip by the return spring and becomes unpowered.

2. The safe electrical outlet of claim 1, wherein a chamber is opened in front of the shell of the protective device; the connecting block made of conductive material is located within the chamber, of which the rear end is close to the live wire conductive clip, the front end protruded is close to the live wire jack of the safe electrical outlet, the rear end having a pivot which is sat in a slot on the side wall of shell turnablely, the upper end is pushed by the return spring; when the plug's live wire pin is inserted into a live wire jack of the electrical outlet, the connecting block is driven to contact the live wire conductive clip, thereby the connecting block and plug's live wire pin are powered, when the plug's live wire pin is pulled out, the connecting block is pushed back to disconnect with live wire conductive clip by the return spring and becomes unpowered.

3. The safe electrical outlet of claim 1, wherein a limitation bar for limiting a rotation angle of the connecting block is arranged at front top of the chamber.

4. The safe electrical outlet of claim 1, wherein a chamber is opened in front of the shell of the protective device, and the connecting block is located within the chamber; a conductive foundation is placed at the bottom of the chamber, and connected with the jack clip of live wire located correspond to the live wire jack of the electrical out let; the connecting block has an insulative portion and a conductive portion, the insulative portion is close to a jack of ground/zero wire of the electrical outlet, with an upper end against the return spring; the conductive portion is close to the live wire conductive clip, with its lower end being turnable connection with the conductive foundation; when the ground/zero wire pin of the plug is inserted into the jack of the electrical outlet, the conductive portion of the connecting block is pushed to contact the live wire conductive clip, thereby the connecting block and plug's live wire pin are powered, when the plug's live wire pin is pulled out, the connecting block is pushed back by the return spring to disconnect with the live wire conductive clip and becomes unpowered.

5. The safe electrical outlet of claim 4, wherein the connecting block's insulative portion is made of plastic and conductive portion made of copper.

6. The safe electrical outlet of claim 5, wherein the connecting block is formed by joining of the plastic insulative portion and copper conductive portion together by glue, the joint face is a wedged surface.

* * * * *